United States Patent [19]

Marse

[11] 4,092,028

[45] May 30, 1978

[54] BOARD GAME APPARATUS

[76] Inventor: Salvadore Marse, 320 S. Harrison St., East Orange, N.J. 07018

[21] Appl. No.: 756,775

[22] Filed: Jan. 5, 1977

[51] Int. Cl.[2] ..... A63F 3/04

[52] U.S. Cl. ..... 273/239; 273/257

[58] Field of Search ..... 273/134

[56] References Cited

U.S. PATENT DOCUMENTS

| | | | |
|---|---|---|---|
| 2,043,482 | 6/1936 | Lord | 273/134 AC |
| 3,318,601 | 5/1967 | MacLeod | 273/134 AC |
| 3,368,816 | 2/1968 | Milazzo et al. | 273/134 AC |

*Primary Examiner*—Richard C. Pinkham
*Assistant Examiner*—Harry G. Strappello
*Attorney, Agent, or Firm*—Leonard W. Suroff

[57] ABSTRACT

A presidential election game in which the fifty states including the District of Columbia are divided into color coordinated zones with magnetized score means for each player to record the changing number of popular and/or electoral college votes he or she has accumulated until a winner is obtained.

10 Claims, 7 Drawing Figures

BOARD GAME APPARATUS

BACKGROUND OF THE INVENTION

1. Field of the Invention

This invention relates to a game, and more particularly to an educational game played on a board with movable pieces in association with said board.

More specifically, the present game is directed to American politics and enables the players thereof to compete for the Presidency of the United States through involvement in a presidential political campaign and in so doing to increase their appreciation and knowledge of the importance and implications of the electoral college system and the vote apportionment connected therewith.

2. Description of the Prior Art

Presidential election games have been disclosed in the prior art, for example, in U.S. Pat. Nos. 753,949; 2,043,482; 3,318,601; and 3,368,816. In contrast to the above, I have invented a novel game that utilizes gaming pieces that move from state to state as one would through an election when the votes are being tallied. Furthermore, there has been provided in my game, magnetic means for continuous updating and tabulation of the number of popular and/or electoral votes of each player. It is to be understood that hereafter when electoral votes are mentioned it also includes the tabulation of the popular votes. The advantages and distinctions of my invention over the prior art will become more clearly evident as the disclosure proceeds.

OBJECTS OF THE INVENTION

An object of the present invention is to provide a political game in which the winner becomes elected President.

Another object of the present invention is to provide apparatus to permit a number of players to participate in an election, with the excitement of winning the election State by State.

Other objects and advantages of the present invention will become apparent as the disclosure proceeds.

SUMMARY OF THE INVENTION

A presidential election game for one of the players to win and thus become "President", which game comprises in combination a playing board having its periphery divided into a series of outer zones and a series of inner zones, with one series of one of the zones being divided into fifty-one State zones including the District of Columbia, each State zone being color designated, and the other of the series of the zones being a corresponding numerical indicium being designative of the number of electoral college votes allocated to the State, and needed to win the State according to the number of players of the game.

A map of the United States is disposed centrally of the playing board, with the boundaries of each State being outlined on the map, with the States being divided into different groups by color designation according to their population and for electoral votes representation, and pathways between adjoining States on the playing board, with a set of chance cards, each chance card having indicia thereon representative of an advantage one player may exercise over another player or a hazard that a player must suffer.

Chance means operable by players of the game apparatus are provided so as to produce a random number for determining the number of States the player may advance, with posting means for indicating the number of electoral votes posted by a player as the game progresses, and a marker for each player that differs in color or configuration, with the marker placed initially on one of the States by each player and progressively moving from State to State by utilization of the chance means through the pathways and accumulating votes in order to win the election and become "President".

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
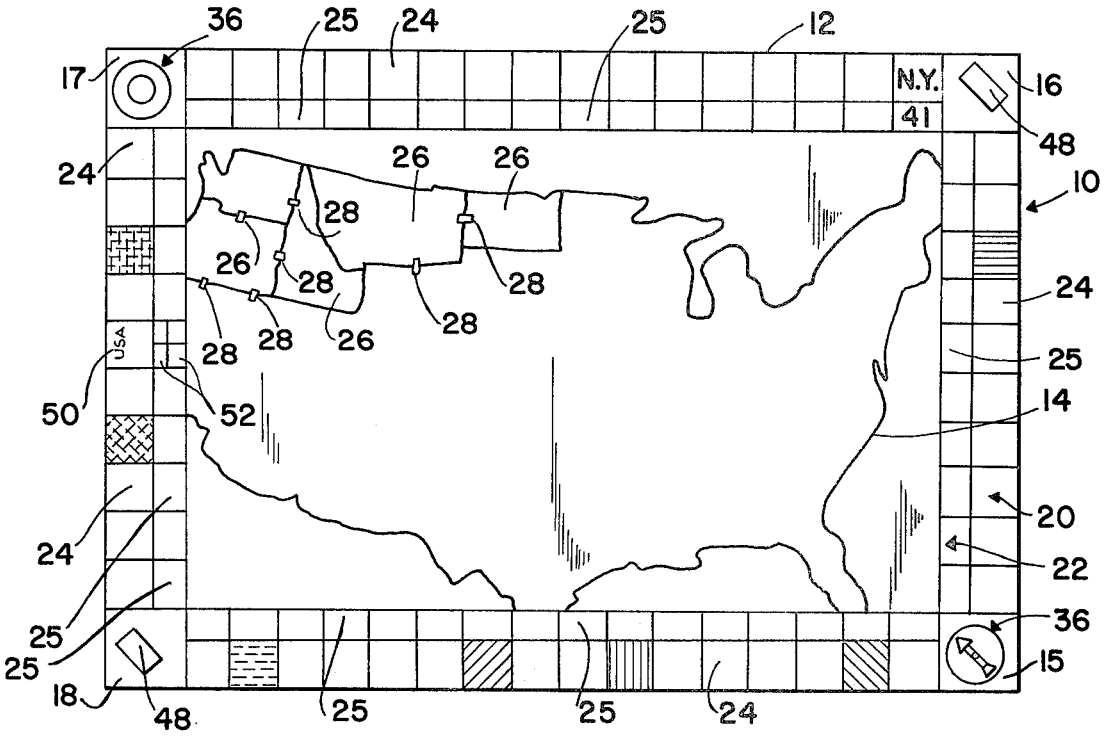
FIG. 1 is a plan view of the playing board in accordance with the present invention.
Figure 2:
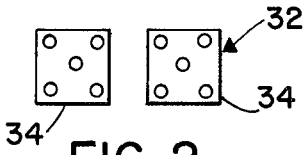
FIG. 2 shows a plan view of a pair of dice which may be used as the chance means.
Figure 3:
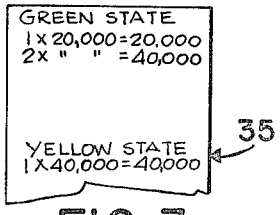
FIG. 3 is a plan view of one of a number of indicating cards, having information contained thereon.
Figure 4:
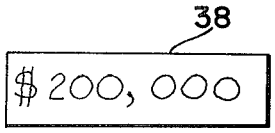
FIG. 4 is a plan view of money available for use with the game.
Figure 5:
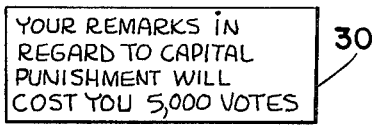
FIG. 5 is a plan view of a chance card, a number of which are supplied with the game.
Figure 7:
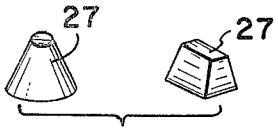
FIG. 7 is a perspective view of markers that may be used for playing the game.
Figure 6:
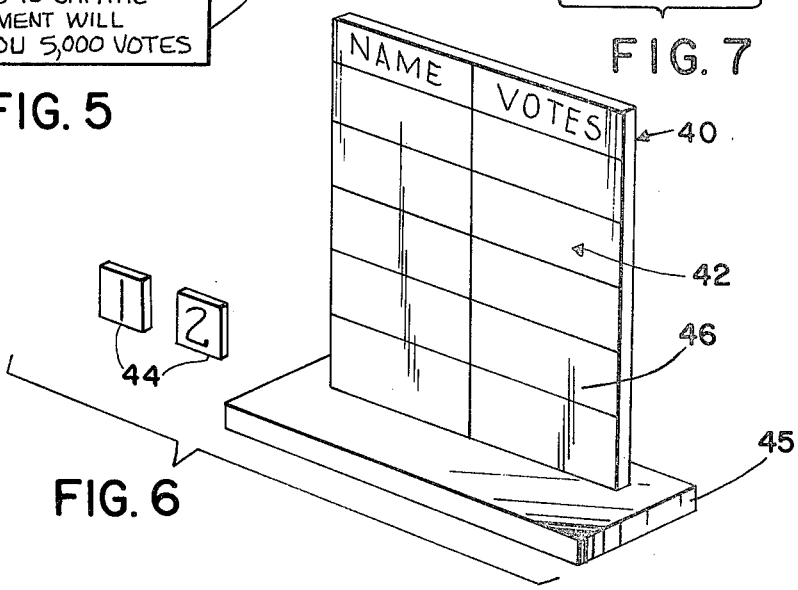
FIG. 6 is a perspective view of magnetized posting means for indicating the electoral votes obtained by each player as the game progresses.

Referring to the drawings, FIGS. 1 through 7 illustrate the novel combination provided in the presidential election game 10 which includes a game board 12 made of any suitable material and provided with a map 14 of the United States that would include all of the fifty States, as well as the District of Columbia. The board 12 has corner sections or zones 15, 16, 17, and 18. In between the respective corner zones 15 through 18 there is provided along the periphery a series of outer zones 20 and inner zones 22.

One set of these zones 20, may include fifty-one individual State zones identified by numeral 24. The State zones 24 include the District of Columbia. A series of colors is selected for respective States, such that each State zone 24 is color designated. The other of the zones 22 containing a corresponding numerical indicium being designative of the number of electoral college votes allocated to the corresponding State.

Accordingly, each indicium zone 25 indicates the number of electoral college votes needed to win the State according to the number of players of the game. The game is played by at least two players.

The map 14, which is disposed centrally of the playing board 12, has the boundaries of each State outlined thereon. The States being identified by numeral 24. The States 26 are divided into different groups by color designation according to their population and for electoral votes representation. During playing of the game each player is to receive a marker 27, not shown, that may take various forms well known in the art. During play of the game the marker 27 is placed on one of the States and movement from State to State is obtained through pathways 28 which joins the States 26 together.

A set of chance cards 30 is provided and has indicia thereon representative of an advantage one player may exercise over another player or a hazard that a player must suffer.

Chance means 32 operable by the players of the game 10 are provided so as to produce a random number for determining the number of States the player may advance. The chance means may be in the form of a pair of dice 34. The chance cards 30 are picked by a player depending upon certain numbers obtained when the pair of dice 34 are thrown. The States 26 may be grouped into seven different color groups with the number of States in each group varying from two up to sixteen States.

To assist the player indicating means 35 is utilized. The indicating means 35 may be in the form of a card which calculates the number of votes the player has obtained on the player's usage of the chance means. The indicating means 35 being in the form of a card that matches the States 26 by color groups identical as the color groups on the playing board 12, and assigning basic multiples of votes to each group, such that these basic multiples are matched with the number the player obtains by the chance means 32, and as a result the player is given a total vote count obtained on each usage of the chance means 32.

The marker for each player differs in color or configuration, with the marker 27 placed initially on one of the States by each player and progressively moving from State to State by utilization of the chance means 32 through the pathways 28 and accumulating votes in order to win the election and become "President". The pathways 28 as to their number between States 26 varying between two and seven.

Roulette means 36 is operatively associated with the playing board 12 at each corner zone 15 and 17 and utilized by a player depending upon certain numbers obtained by the chance means 32. A source of money 38 may be distributed to each player at the start of the game for use in conjunction with certain of the chance cards 30.

Posting means 40 is utilized for indicating the number of electoral votes posted by a player as the game progresses, and includes magnetic vote tabulation means 42 for the individuals playing the game, and a plurality of magnetized pieces 44 having numerals thereon, with the pieces 44 adapted to be placed on the vote tabulation means 42. The vote tabulation means 42 includes a base 45 and a vertically extending wall 46.

The chance cards 30 are placed on the corner zones 16 and 18 in a rectangular portion 48 provided for this purpose. In addition, each die 34 may have a different color such that a limit of six States in movement may be obtained by a player at one time. A summary zone box 50 may be provided which further indicates in boxes 52 the tabulation totals necessary to win the game depending on the number of players playing.

The operation of the game and additional information with respect thereto is contained in the description of the game as set forth below.

In its present form two to four players can play the game 10. The game board 12 depicts the map of the USA with assorted pathways 28 leading from one State 26 to the other. The States 26 are grouped in seven different color groups according to their population and for electoral votes representation. In its present form the number of States in each group vary from one containing only two States to one group with five, etc., up to one group with maximum of sixteen States. The pathways 28 between States are in its present form in two different colors, some States have only two pathways (minimum). The average pathways 28 leading to or from one State are four, and there is one State with a maximum of seven pathways.

In playing the game each player rolls his or her pair of dice 34 when their turn comes up and advances to the State 26 the player wishes or can reach if the number and dice color can follow and/or match the pathway colors. Upon landing on the State or District of Columbia 26 (fifty States and Washington, D.C. included in game), the player calculates the number of votes obtained on that throw by looking in the indicating means 35 each player is provided with and which in a simple way tells the player how many votes were obtained. This card 35 matches the States by color groups identical as the color State groups on the game board 12 in the map 14 and assigns basic multiples of votes to each group. These basic multiples are matched with the number the player rolls with the dice 34, and as a result the player is given the total vote count obtained in that throw. On the tabulation or posting means 40 the number of votes gained by each player on each state is posted. This will vary as the game progresses for each player. The supply of magnetized pieces 42 are magnetically posted as the electoral votes per player changes.

Players roll the dice 34 and advance with certain privileges whenever they roll a double, and also in its preferred embodiment whenever certain numbers are rolled, like seven, they are entitled to draw chance cards 30 and/or turn the roulette 36. Some chance cards 30 have advantages, other have disadvantages to the player and/or his opponents. They deal with transference of votes, loss or gaining extra votes, also missing or taking extra throws. They also deal with money matters (e.g. money 38 obtained through special ways for votes, etc.).

The money 38 is distributed to each player at the start of the game. As the game progresses players keep adding votes to the States they reach and upon winning some States the number of electoral votes are added and posted on the posting means 40. Each player has to have votes in a minimum number of States, preferably forty, in order to qualify to become President. The votes needed to win in each State have been determined by a percentage of the ideal number of voters in each State and based on census population and general USA voting trends in past elections. Each player is represented by a marker, each one in a different color, that corresponds with the color money 38. Color chance cards 30, with printed number of votes, color cards 35, with electoral votes number, are given to each player.

Starting point can be either Washington, D.C., or Nebraska (geographical center of USA). The States 26 are represented in the zones 25 around the map 14 and given information in regard to the number of electoral votes. The number of voters (ideal calculated), population according to census 1970, and also information in regard to possible number of minimum votes required to win when playing with different number of players is contained in each zone 25.

In addition, the game may have provision for simultaneously selecting Senators and Representatives to the U.S. Congress. The player will win the two Senators, upon winning a State, and the members to the House of Representatives will be assigned on a percentage basis.

Obviously, many variations within the scope of the above described game rules can be obtained in order to elect a President with the required number of electoral college votes that are required for a particular player to win. All such changes being within the scope of the present invention.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A presidential election game for one of the players to win and thus become "President, " said game comprises in combination:

a. a playing board having its periphery divided into a series of outer zones and a series of inner zones, b. said series of one of said zones being divided into fifty-one State zones including the District of Columbia, each State zone being color designated, c. said other of said series of said zones being a corresponding numerical indicium being designative of the number of popular and/or electoral college votes allocated to said state, and needed to win the state according to the number of players of the game, d. a map of the United States disposed centrally of said playing board, the boundaries of each State being outlined on said map, e. said States being divided into different groups by color designation according to their population and for electoral votes representation, f. pathways between adjoining States on said playing board, g. a set of chance cards, each chance card having indicia thereon representative of an advantage one player may exercise over another player or a hazard that a player must suffer, h. chance means operable by players of said game apparatus so as to produce a random number for determining the number of States the player may advance, i. posting means for indicating the number of popular and/or electoral votes posted by a player as the game progresses, and j. a marker for each player that differs in color or configuration, said marker placed initially on one of said States by each said player and progressively moving from State to State by utilization of said chance means through said pathways and accumulating votes in order to win the election and become "President."

2. A presidential election game as in claim 1, wherein said posting means includes:

a. magnetic vote tabulation means for the individuals playing the game, and b. a plurality of magnetized pieces having numerals thereon, said pieces adapted to be placed on said vote tabulation means.

3. A presidential election game as in claim 2, wherein said vote tabulation means includes a base and a vertically extending wall.

4. A presidential election game as in claim 1, said pathways as to their number between States varying between two and seven.

5. A presidential election game as in claim 1, a. wherein said chance means comprises a pair of dice, and b. wherein said chance cards are picked by a player depending upon certain numbers obtained by said pair of dice.

6. A presidential election game as in claim 1, a. said States are grouped into seven different color groups, and b. said number of States in each group varying from two up to sixteen States.

7. A presidential election game as in claim 1, and indicating means available to each player that can be utilized so as to determine the number of votes the player has obtained on the player's usage of said chance means.

8. A presidential election game as in claim 7, said indicating means being in the form of a card that matches the States by color groups identical as the color groups on said playing board, and assigning basic multiples of votes to each group, such that these basic multiples are matched with the number the player obtains by said chance means and as a result the player is given a total vote count obtained on each usage of said chance means.

9. A presidential election game as in claim 1, and roulette means operatively associated with said playing board and utilized by a player depending upon certain numbers obtained by said chance means.

10. A presidential election game as in claim 1, and money distributed to each of the players at the start of the game for use in conjunction therewith.

* * * * *